United States Patent [19]

Abel et al.

[11] Patent Number: 4,728,337

[45] Date of Patent: Mar. 1, 1988

[54] ASSISTANT COMBINATION AND USE THEREOF AS WOOL TEXTILE FINISHING AGENT

[75] Inventors: Heinz Abel, Reinach; Rosemarie Töpfl, Dornach; Franz Günter, Riehen, all of Switzerland

[73] Assignee: Ciba-Geigy Corporation, Ardsley, N.Y.

[21] Appl. No.: 925,027

[22] Filed: Oct. 30, 1986

[30] Foreign Application Priority Data

Nov. 8, 1985 [CH] Switzerland ..... 4802/85

[51] Int. Cl.[4] ..... D06M 13/46; D06M 15/37; D06P 1/66; D06P 3/16

[52] U.S. Cl. ..... 8/606; 8/543; 8/551; 8/554; 8/602; 8/680; 8/681; 8/917

[58] Field of Search ..... 8/606, 602, 554

[56] References Cited

U.S. PATENT DOCUMENTS

| | | | |
|---|---|---|---|
| Re. 27,333 | 4/1972 | Solron et al. | 8/551 |
| Re. 27,386 | 6/1972 | Solron et al. | 8/543 |
| 2,891,835 | 6/1959 | Matter et al. | 8/606 |
| 3,097,039 | 7/1963 | Buehler et al. | 8/606 |
| 3,490,859 | 1/1970 | Solron et al. | 8/549 |
| 3,652,201 | 3/1972 | Bindler | 8/541 |
| 3,681,128 | 8/1972 | Berger et al. | 427/386 |
| 4,312,813 | 1/1982 | Lindemann et al. | 260/404.5 |
| 4,467,486 | 9/1984 | Solron et al. | 8/549 |
| 4,475,920 | 10/1984 | Baumann | 8/542 |
| 4,604,101 | 8/1986 | Kissung et al. | 8/551 |
| 4,615,709 | 10/1986 | Nakao | 8/599 |

FOREIGN PATENT DOCUMENTS 2154618 9/1985 United Kingdom .

*Primary Examiner*—A. Lionel Clingman

*Attorney, Agent, or Firm*—Edward McC. Roberts; Meredith C. Findlay

[57] ABSTRACT

An assistant combination for use as textile finishing agent, especially in a process for aftertreating wool dyeings, which comprises (1) a diquaternary ammonium salt of formula (1)

wherein

Q is a divalent aliphatic hydrocarbon radical of 2 to 12 carbon atoms which may be interrupted in the chain by oxygen atoms and is unsubstituted or substituted by hydroxy.

$R_1$ and $R_2$ are each independently of the other an aliphatic radical of 6 to 24 carbon atoms, $R_3$ to $R_6$ are independently of the other lower alkyl, hydroxy-lower alkyl or lower alkoxy-lower alkyl, $X_1$ and $X_2$ are each oxygen or —NH—, $Z_1$ and $Z_2$ are each independently of the other $C_2$–$C_6$alkylene, and $Y^{\ominus}$ is an anion of a strong inorganic or organic acid, and (2) (A) a mono- or polyquaternary ammonium salt which carries at least one hydrocarbon radical of not less than 7 carbon atoms attached to the nitrogen atom, or (B) a polymeric ammonium salt, or (C) a basic non-quaternized nitrogen-containing polycondensate.

15 Claims, No Drawings

ASSISTANT COMBINATION AND USE THEREOF AS WOOL TEXTILE FINISHING AGENT

The present invention relates to a novel assistant combination and the use thereof as textile finishing agent, especially in a process for aftertreating wool dyeings.

Specifically, the invention relates to an assistant combination which, compared with the hitherto known agents for improving fastness properties, especially wetfastness and crockfastness, of wool dyeings, not only enhances the fastness properties but is also able to inhibit the soiling of textile material caused e.g. by dust (dry soiling) or by dirt released from wash or solvent liquors (wet soiling) in laundering. On account of the additional softening properties, the novel combination also imparts a soft, fleecy handle to the textile material and thus pleasing wear characteristics.

Accordingly, the present invention relates to an assistant combination which comprises (1) a diquaternary ammonium salt of formula

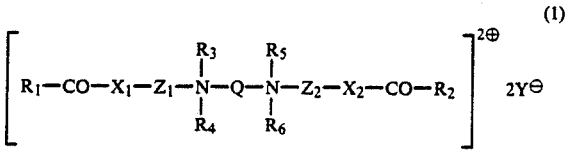

(1)

wherein

Q is a divalent aliphatic hydrocarbon radical of 2 to 12 carbon atoms which may be interrupted in the chain by oxygen atoms and is unsubstituted or substituted by hydroxyl groups, $R_1$ and $R_2$ are each independently of the other an aliphatic radical of 6 to 24 carbon atoms, $R_3$ to $R_6$ are each independently of the other lower alkyl, hydroxy-lower alkyl or lower alkoxy-lower alkyl, $X_1$ and $X_2$ are each oxygen or —NH—, $Z_1$ and $Z_2$ are each independently of the other $C_2$–$C_6$ alkylene, and $Y^{\ominus}$ is an anion of a strong inorganic or organic acid, and (2) (A) a mono- or polyquaternary ammonium salt which carries at least one hydrocarbon radical of not less than 7 carbon atoms attached to the nitrogen atom, or (B) a polymeric ammonium salt, or (C) a basic non-quaternised nitrogen-containing polycondensate.

Components (1) and (2) may be present as single compounds or as a mixture with each other.

In the definition of the radicals of formula (1) and in the subsequent formulae, lower alkyl and lower alkoxy denote those groups or moieties which contain 1 to 5, preferably 1 to 3, carbon atoms. Lower alkyl groups are for example methyl, ethyl, n-propyl, iso-propyl, n-butyl, sec-butyl, tert-butyl or amyl, and lower alkoxy groups are for example methoxy, ethoxy or isopropoxy.

The aliphatic radicals $R_1$ and $R_2$ may be straight chain or branched. Together with the —CO— group, they preferably form the acid radical of an unsaturated or, preferably, saturated aliphatic carboxylic acid of 8 to 24 carbon atoms. Examples of suitable aliphatic carboxylic acids are: 2-ethylhexanoic acid, capric acid, lauric acid, coconut fatty acid, myristic acid, palm oil fatty acid, palmitic acid, tallow fatty acid, oleic acid, ricinoleic acid, linoleic acid, linolenic acid, stearic acid, arachidic acid, arachidonic acid, behenic acid, erucic acid or lignoceric acid. Behenic acid is the preferred acid. It is also possible to use the mixtures of these acids obtained by the cleavage of natural oils or fats.

Coconut fatty acid, palm oil fatty acid, palmitic acid/stearic acid mixtures, tallow fatty acid and, in particular, arachidic acid/behenic acid mixtures are especially preferred mixtures.

Preferably each of $R_1$ and $R_2$ is a $C_7$–$C_{23}$ alkyl radical, most preferably a $C_{19}$–$C_{21}$ alkyl radical.

The lower alkyl radicals $R_3$ to $R_6$ are preferably identical and are preferably methyl, ethyl, ethyl, isopropyl or hydroxyethyl, with methyl being especially preferred.

$X_1$ and $X_2$ are preferably —NH—.

$Z_1$ and $Z_2$ are preferably a $C_2$–$C_5$ alkylene group which may be straight chain or branched and is e.g. the $-CH_2CH_2-$, $-CH_2CH_2CH_2-$, $-CH_2CH_2CH_2CH_2-$, $-CH_2-\underset{\underset{CH_3}{|}}{CH}-$ or $-CH_2-\overset{\overset{CH_3}{|}}{\underset{\underset{CH_3}{|}}{C}}-CH_2-$ group.

$-CH_2CH_2-$ and, in particular, $-CH_2CH_2CH_2-$ are most preferred.

The aliphatic hydrocarbon chain in the bridge Q contains preferably 3 to 10 carbon atoms. It may be straight chain or branched.

Preferably Q is a $C_3$–$C_{10}$ alkylene radical which may be interrupted in the chain by oxygen and is unsubstituted or substituted by hydroxyl groups.

Preferred bridges Q are $-CH_2-\underset{\underset{OH}{|}}{CH}-CH_2-$, $-CH_2-\overset{\overset{CH_3}{|}}{CH}-O-CH_2\overset{\overset{CH_3}{|}}{CH}-$, $-CH_2-\underset{\underset{OH}{|}}{CH}-\underset{\underset{OH}{|}}{CH}-CH_2-$, $-(CH_2)_2-O-(CH_2)_2-$, $-CH_2-CH_2-CH_2-CH_2-$, $-CH_2-(CH_2)_4-CH_2-$ or $\left[-CH_2-\underset{\underset{OH}{|}}{CH}-CH_2-O-\right]_2-(CH_2)_4$, with $-CH_2-\underset{\underset{OH}{|}}{CH}-CH_2-$ or, in particular, $-CH_2-\underset{\underset{OH}{|}}{CH}-CH_2-O-(CH_2)_4-O-CH_2-\underset{\underset{OH}{|}}{CH}-CH_2-$ being most preferred.

Suitable anions $Y^{\ominus}$ are anions of inorganic acids, e.g. the chloride, bromide, fluoride, iodide or sulfate ion, as well as anions of organic acids, e.g. of aromatic or aliphatic sulfonic acids, e.g. the benzenesulfonate, p-toluenesulfonate, chlorobenzenesulfonate, methanesulfonate or ethanesulfonate ion, and also the anions of lower carboxylic acids such as the acetate, propionate or oxalate ion.

$Y^{\ominus}$ is preferably the chloride, bromide, sulfate or p-toluenesulfonate ion.

The diquaternary ammonium salts of formula (1) are prepared in a manner known per se. They are preferably prepared by reacting 1 mole of a compound of formula

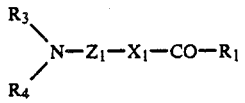

(2a)

and 1 mole of a compound of formula

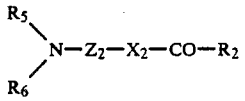

(2b)

or 2 moles of the same compound with 1 mole of a compound which introduces Q and contains two functional groups, e.g. epihalohydrin, a dihaloalkane, a dihaloalkyl ether, an olefin dioxide, a diepoxy compound such as an $\alpha,\omega$-alkanediol diglycidyl ether or an alkanediol alkylsulfonate or alkanediol arylsulfonate.

The reaction is preferably carried out in a polar solvent and, if necessary, with the addition of a hydrohalic acid such as hydrochloric acid or sulfuric acid.

Suitable polar solvents are water or, preferably, water-miscible organic solvents. Examples of water-miscible organic solvents are aliphatic $C_1$–$C_3$ alcohols such as methanol, ethanol or the propanols; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone and diacetone alcohol; ethers such as diisopropyl ether, diphenyl oxide, dioxane, tetrahydrofuran, as well as tetrahydrofurfuryl alcohol, acetonitrile, Y-butyrolactone, N,N-dimethylformamide. Mixtures of these solvents may also be used.

As a suitable quaternary ammonium salt (A) of component (2) it is possible to use a reaction product of aliphatic or araliphatic monoamines and/or diamines which contain tertiary amino groups and a lipophilic radical with epihalohydrin. Such compounds are described e.g. in DE-B 1 092 878 or DE-C 1 921 827.

Preferably the quaternary ammonium salt (A) of component (2) consists of at least one of the following quaternary ammonium compounds:

(a) a mono- or diquaternary ammonium salt of formula

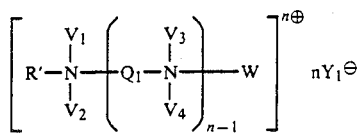

(3)

or (b) a diquaternary or tetraquaternary ammonium salt of formula

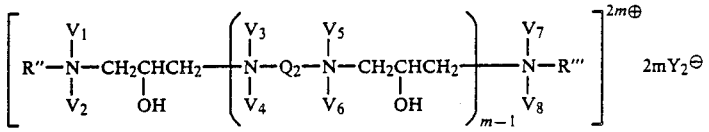

wherein $Q_1$ and $Q_2$ are each independently of the other a $C_2$–$C_{12}$ alkylene radical which may be interrupted by oxygen or $—NV_9$ and is unsubstituted or substituted by hydroxyl, R', R'' and R''' are each independently an aliphatic radical of 6 to 24 carbon atoms or an araliphatic radical, e.g. benzyl, $V_1$ to $V_9$ are each independently lower alkyl or hydroxy-lower alkyl, e.g hydroxyethyl, ethyl or, preferably, methyl, W is

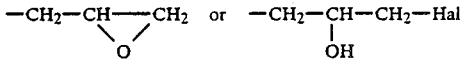

Hal is a halogen atom, such as a bromine or, preferably, a chlorine atom, n and m are each 1 or 2, and $Y_1^{\ominus}$ and $Y_2^{\ominus}$ are each an anion of a strong inorganic or organic acid.

A polymeric ammonium salt (B) of component (2) is suitably a water-soluble reaction product of a peralkylated diamine or triamine with a dihaloalkane, dihalodimethyldiphenyl, dihaloalkyl ether or, preferably, an epihalohydrin. Such polymeric quaternary ammonium salts are described e.g. in DE-A 26 57 582 and DE-A 28 24 743.

Especially preferred polymeric ammonium salts contain the recurring unit of formula

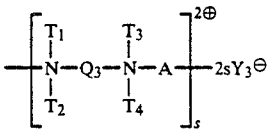

(5)

wherein $Q_3$ is a $C_2$–$C_6$ alkylene radical which may be interrupted by $—NT_5—$, $T_1$ to $T_5$ are each independently lower alkyl or hydroxy-lower alkyl, A is a group selected from

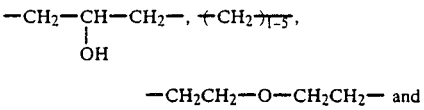

and

-continued

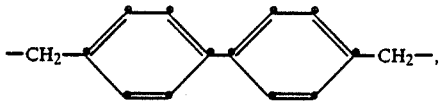

s is 3 to 100, preferably 3 to 30, and $Y_3\ominus$ is the anion of a strong inorganic or organic acid.

A particularly preferred polymeric ammonium salt of component (2) contains the recurring unit of formula

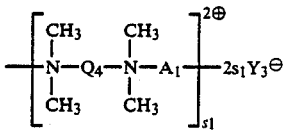

(6)

wherein $Q_4$ is $-(CH_2)_6-$ or $$-CH_2CH_2-\underset{\underset{CH_3}{|}}{N}-CH_2CH_2-,$$

$A_1$ is a group selected from $$-CH_2-\underset{\underset{OH}{|}}{CH}-CH_2-,\ -CH_2CH_2-O-CH_2CH_2- \text{ and}$$

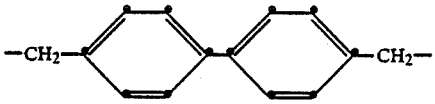

$s_1$ is 3 to 30, and $Y_3\ominus$ has the given meaning.

Suitable basic non-quaternised, nitrogen-containing polycondensates (C) of component (2) are amino group-containing condensates which are obtained by reacting dicyandiamide, cyanamide, guanidine or bisguanidine and polyalkylamines containing not less than three primary and/or secondary amino groups, which condensates may be further reacted with epihalohydrin. These polycondensates (C) and the corresponding starting materials are known from DE-B 1 595 390 and can be prepared in accordance with the method described therein.

Further suitable nitrogen-containing polycondensates are basic polyamides which are obtained by condensation of polymeric, preferably dimeric to trimeric, unsaturated fatty acids and polyalkylenepolyamines containing not less than 3 amino groups and 4 to 12 carbon atoms, conveniently in such a ratio that the resultant polyamide resin has an amine number in the range from 200 to 650 mg of potassium hydroxide per gram of polyamidepolyamine. Such polyamidepolyamines are described e.g. in UK Pat. No. GB-B-1 276 461 or in DE-A-2 000 204.

The polymerised unsaturated fatty acids required are preferably dimerised or trimerised fatty acids which are derived from monocarboxylic acids of 12 to 24, preferably 16 to 22 and, most preferably, 16 to 18, carbon atoms. These monocarboxylic acids contain at least one ethylenically unsaturated group and preferably 2 to 5 such groups. Typical representatives of this class of acids are: lauroleic acid, myristoleic acid, palmitoleic acid, physetoleic acid, oleic acid, elaidic acid, petroselinic acid, eicosenoic acid, cetoleic acid, gadoleic acid, erucic acid, eleostearic acid, parinaric acid, arachidonic acid, clupadonic acid, nisinic acid and, in particular, linoleic acid and linolenic acid. These fatty acids can be obtained from natural oils of vegetable or animal origin.

These dimerised to trimerised fatty acids are prepared in known manner by dimerisation of monocarboxylic acids of the indicated kind. The polymerised fatty acids are technical mixtures which always contain an amount of trimerised acids and a small amount of monomeric acids.

Dimerised or trimerised linoleic acid or linolenic acid is particularly suitable. The technical mixtures of these acids usually contain 75 to 95 percent by weight of dimerised acid, 4 to 25 percent by weight of trimerised acid and a trace to 3 percent by weight of monomeric acid. The molar ratio of dimerised acid to trimerised acid is thus about 5:1 to 36:1.

Suitable polyalkylenepolyamines are amines of formula $$H_2N-(CH_2-CH_2-NH)_{n_1}-CH_2-CH_2-NH_2, \quad (7)$$

wherein $n_1$ is 1 to 5, preferably 1, 2 or 3, i.e. diethylenetriamine, triethylenetetramine or tetraethylenepentamine, with triethylenetetramine being especially preferred.

Further polyamide resins are for example the products obtained by reaction of halohydrins, e.g. epichlorohydrin, with aminopolyamines and polyalkyleneamines and aliphatic dicarboxylic acids of 2 to 10 carbon atoms, and which are described e.g. in U.S. Pat. No. 3,311,594.

Components (1) and (2) are usually employed in a weight ratio of 2:1 to 1:5, preferably of 1:1 to 1:2.

The novel assistant combination is preferably used as an aftertreating agent for wool dyeings, for which utility they simultaneously enhance the fastness properties of the dyeings and act as inhibitor for soiling of the goods.

To this end, components (1) and (2) are normally added separately to the aftertreatment liquor. The combination can, however, also be employed in the form of an aqueous formulation. This formulation can be prepared by simple stirring of the components in water, if necessary by heating to 50°-70° C., and diluting with water to give a 20 to 40% solution.

The present invention thus also releates to a process for aftertreating wool-containing fibre material with anionic dyes, which process comprises treating said material with an aqueous liquor which contains the assistant combination of this invention, i.e. components (1) and (2).

Suitable wool-containing material is wool itself or wool/polyester or wool/polyamide blends.

The fibre-material may be in a very wide range of presentation, for example as flocks, slubbing, wovens, knits, nonwovens, yarn or piece goods.

The anionic dyes employed in the process of this invention may be for example salts of heavy metal-containing or metal-free monoazo, disazo or polyazo dyes, including formazan dyes, as well as of anthraquinone, xanthene, nitro, triphenylmethane, naphthoquinoneimine and phthalocycanine dyes. The anionic character of these dyes can be determined by metal complexing alone and/or preferably by acid salt-forming substituents such as carboxylic acid groups, sulfuric acid groups and phosphonate groups, phosphonic acid groups or sulfonic acid groups. These dyes may also contain reactive groups in the molecule, which groups are able to form a covalent bond with the material to be dyed. Acid metal-free reactive dyes which preferably contain two sulfonic acid groups are preferred.

Of particular interest are also the 1:1 metal complex or, preferably, 1:2 metal complex dyes. The 1:1 metal complex dyes preferably contain one or two sulfonic acid groups. As metal they contain a heavy metal atom, for example a copper, nickel or, preferably, chromium atom. The 1:2 metal complexes contain as central metal atom a heavy metal atom, for example a cobalt atom or, preferably, a chromium atom. Two complexing components are attached to the central metal atom, at least one of which components is a dye molecule; but preferably both components are dye molecules. Further, the two complexing dye molecules may be identical or different. The 1:2 metal complex dyes may contain e.g. two azomethine molecules, one disazo dye molecule and one monoazo dye molecule or, preferably, two monoazo dye molecules. The azo dye molecules may contain water solubilising groups, e.g. acid amide groups, alkylsulfonyl groups or the acid groups mentioned above. Preferred 1:2 metal complex dyes are 1:2 cobalt or 1:2 chromium complexes of monoazo dyes, which complexes contain acid amide groups, alkylsulfonyl groups or a single sulfonic acid group. Particularly preferred 1:2 metal complex dyes are 1:2 chromium mixed complexes of azo dyes wherein the complexes contain one sulfonic acid group.

The wool dyeings are preferably produced with the following groups of dyes:

A. 1:1 Chrome complex dyes which contain sulfonic acid groups, i.e. complex chromium compounds of dyes, especially monoazo dyes, wherein one chromium atom is attached to a complex dye molecule and which contain at least one sulfonic acid group in the molecule.

B. 1:2 Chrome or cobalt complex dyes, the complex molecule of which contains 1 or 2 acid water-solubilising groups which do not participate in the complexing, preferably sulfonic acid groups.

C. Reactive dyes obtained from azo dyes which contain one or two acid water-solubilising groups, preferably sulfonic acid groups.

D. 1:2 Chrome or cobalt complex dyes which are devoid of acid groups but contain water-solubilising groups such as sulfonyl groups, e.g. $C_1$–$C_4$ alkylsulfonyl groups or sulfonamide groups which may be substituted by one or two $C_1$–$C_4$ alkyl groups.

Preferred dyes are 1:2 cobalt or, most preferably, 1:2 chrome mixed complexes of azo dyes which contain a single sulfonic acid group in the complex molecule.

It is also possible to use mixtures of anionic dyes. For example, mixtures of at least 2 or 3 anionic dyes can be used for obtaining level bichromatic or trichromatic dyeings. It is particularly preferred to use dye mixtures comprising a reactive dye that contains at least two sulfonic acid groups and a 1:2 metal complex dye. The mixture ratio may vary from 9:1 to 1:9.

Dyeing may be carried out by the exhaust process, pad process or by printing. The amount of dye added to the dyebath depends on the desired depth of shade. In general, amounts of 0.1 to 10% by weight, preferably of 0.5 to 5% by weight, based on the fibre material, have proved suitable.

The aftertreatment of the dyed wool material of this invention is normally carried out after dyeing, but is preferably effected from a fresh bath. It is preferably carried out by the exhaust process, but can also be equally well carried out continuously by the pad process.

In the exhaust process, the liquor to goods ratio may be chosen within a wide range, e.g. from 1:3 to 1:100, preferably from 1:10 to 1:50. The dyeing temperature is conveniently in the range from 20° to 98° C., preferably from 40° to 60° C. in the exhaust process and 20° to 30° C. in the pad process.

Special apparatus is not required for carrying out the process of this invention. Conventional dyeing apparatus such as open baths, winchbecks, jiggers, paddle, jet or circulation dyeing machines may be employed.

The treatment baths contain each of components (1) and (2) in the exhaust process preferably in an amount of 0.2 to 5% by weight, most preferably 0.5 to 2% by weight, based on the weight of the wool, whereas in padding liquors, components (1) and (2) are each conveniently used in an amount of 1 to 50 g/l, preferably 10 to 30 g/l. Components (1) and (2) are present in the weight ratio indicated above. In the pad process, the pick-up is conveniently from 60 to 90% by weight.

The aftertreatment baths may contain mineral acids such as sulfuric acid or phosphoric acid, organic acids, preferably lower aliphatic carboxylic acids such as formic acid, acetic acid or oxalic acid, and/or salts such as ammonium acetate, ammonium sulfate or sodium acetate. The acids are added in particular to adjust the pH of the dyebaths, which is normally in the range from 4 to 8, preferably from 5 to 6.

The treatment baths may contain conventional assistants such as wool protective agents, dispersants and wetting agents as well as antifoams.

The aftertreatment of the wool-containing material is conveniently carried out such that the material is treated, after dyeing but from a fresh bath, with an aqueous liquor that contains components (1) and (2) and, optionally, an acid. Preferably the dyed wool material is put into a liquor that contains components (1) and (2) and acid and has a pH of 4.5 to 6 and a temperature of 40° C. and the wool is treated at this temperature for 15 to 45 minutes, preferably for 20 to 30 minutes.

The aftertreatment process of this invention enhances the wetfastness properties and the crockfastness and, at the same time, surprisingly also effects soil inhibition. Dye yield and lightfastness are not impaired.

In the following Examples, parts and percentages are by weight.

PREPARATORY EXAMPLES

Example I 119.6 g of dimethylaminopropylcoconut fatty acid amide are dissolved in 70 g of isopropanol and to this solution is added a solution of 19.7 g of concentrated hydrochloric acid in 94 ml of deionised water. Then 18.5 g of epichlorohydrin are added dropwise at 55° C. over 20 minutes. The reaction temperature is then raised to 75° C. and the reaction mixture is stirred for 2 hours. After this time, amine the epoxide numbers are 0.

321 g of a 45% aqueous solution of the ammonium salt of formula

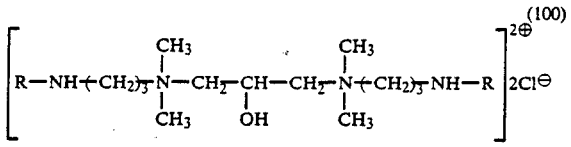

(100)

R = coconut fatty acid radical are obtained.

Example II 109.75 g of dimethylaminopropylbehenamide are dissolved in 44 g of isopropanol with heating and to this solution is then added a solution of 12.3 g of concentrated hydrochloric acid in 74 ml of deionised water. Then 11.6 g of epichlorohydrin are added dropwise at 55° C. over 15 minutes. The reaction temperature is then raised to 75° C. and the reaction mixture is stirred for 3 hours. After this time, amine and epoxide numbers are 0.

251 g of a 50% solution (wax-like at 20° C.) of the ammonium salt of formula

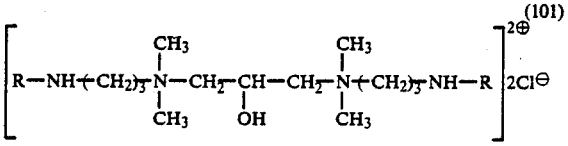

(101)

R = behenic acid radical are obtained.

Example III 84.3 g of dimethylaminopropyl-2-ethylhexanamide are dissolved in 35 g of isopropanol and to this solution is then added a solution of 18.25 g of concentrated hydrochloric acid in 73 ml of deionised water. Then 17.1 g of epichlorohydrin are added dropwise at 55° C. over 30 minutes. The reaction temperature is then raised to 75° C. and the reaction mixture is stirred for 5 hours. After this time, amine and epoxide numbers are 0.

227 g of a 50% clear solution of the ammonium salt of formula

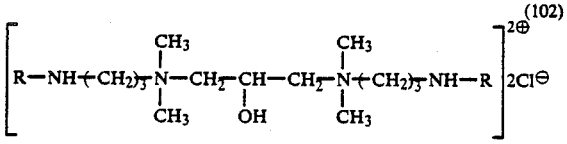

(102)

R = 2-ethylhexanoic acid radical are obtained.

Example IV

To 106.25 of dimethylaminoethylbehenamide is added at 60° C. a solution of 12.3 g of concentrated hydrochloric acid in 73 ml of water and 43 g isopropanol. Then 11.6 g of epichlorohydrin are added dropwise over 15 minutes and the reaction temperature is then raised to 75° C. The reaction solution is stirred for 10 hours at this temperature. After this time, amine and epoxide numbers are 0. The reaction solution is then evaporated to dryness, affording 122 g of the ammonium salt of formula (103)

R = behenic acid radical

Preparation of dimethylaminopropylbehenamide 166 g of behenic acid are fused and heated to 160° C. under nitrogen. The 58.85 g of dimethylaminopropylamine are added dropwise over 1κ hours while removing the water formed through a descending cooler. After 5 hours at 170°-175° C. the reaction is complete. The acid number is 0 and the amine number is 138 (theory: 133).

The dialkylaminoalkylbehenamides or dialkylaminoalkylbehenates listed in Table i are prepared in similar manner by reacting behenic acid with the appropriate diaminoalkylamine or dialkylaminoalkanol.

TABLE i

| Dialkylaminoalkylamine or dialkylaminoalkanol | Dialkylaminoalkylbehenamide or dialkylaminoalkylbehenate | Amine number |
|---|---|---|
| dimethylaminoethylamine | dimethylaminoethylbehenamid | 131.7 |
| diethylaminoethylamine | diethylaminoethylbehenamid | 134 |
| diisopropylaminoethylamine | diisopropylaminoethylbehenamid | 132 |
| dimethylaminoneopentylamine | dimethylaminoneopentylbehenamid | 122 |
| dimethylamino-n-propanol | dimethylamino-n-propylbehenate | 138.6 |

Example V

To 101 g of dimethylaminopropylbehenamide is added at 60° C. a solution of 12.3 g of concentrated hydrochloric acid in 73 g of water. Then 11.6 of epichlorohydrin are added dropwise over 15 minutes and the reaction temperature is then raised to 75° C. The reaction solution is stirred for 10 hours at this temperature. After this time, amine and epoxy numbers are 0. The reaction solution is then evaporated to dryness, affording 117 g of the ammonium salt of formula

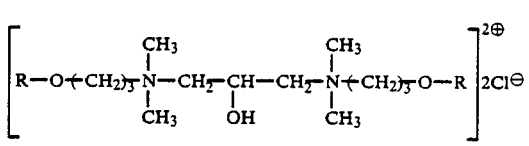

(104)

R = behenic acid radical

Example VI

To 104.5 g of diethylaminoethylbehenamide is added at 60° C. a solution of 12.3 g of concentrated hydrochloric acid in 73 g of water. Then 11.6 g of epichlorohydrin are added dropwise over 15 minutes and the reaction temperature is then raised to 75° C. The reaction solution is stirred for 10 hours at this temperature. After this time, amine and epoxy numbers are 0. The reaction solution is then evaporated to dryness, affording 120 g of the ammonium salt of formula

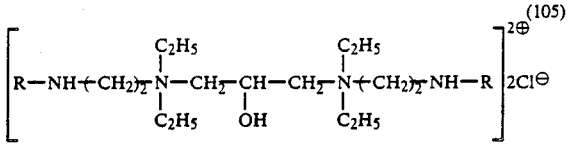

(105)

R = behenic acid radical

Example VII 24 g of dimethylaminopropylbehenamide are heated in 27 g of dimethylformamide to 100° C. Then a solution of 11.2 g of diethylene glycol-bis(4-methylbenzene)sulfonate in 25.8 g of dimethylformamide is added dropwise over 30 minutes and the reaction mixture is stirred for 10 hours at 100°-105° C. After this time the amine content is 0. The reaction solution is then evaporated to dryness under vacuum, affording 35 g of the ammonium salt of formula

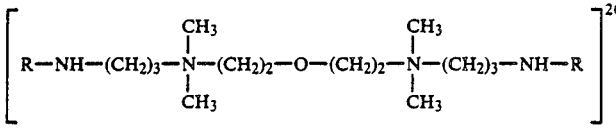

R = behenic acid radical

Example VIII 43.85 g of dimethylaminopropylbehenamide are heated in 50 g of dimethylformamide to 100° C. Then a solution of 19.9 g of 1,4-butanediol-bis(4-methylbenzene)sulfonate in 45.6 g of dimethylformamide is added dropwise over 30 minutes and the reaction mixture is stirred for 10 hours at 100°-105° C. After this time the amine content is 0. The reaction solution is then evaporated to dryness under vacuum, affording 63 g of the ammonium salt of formula

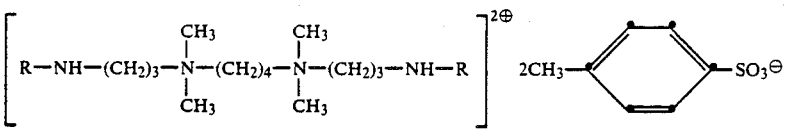

(107)

R = behenic acid radical

Example IX 43.85 g of dimethylaminopropylbehenamide are heated in 50 g of dimethylformamide to 100° C. Then a solution of 13.7 g of 1,6-hexanediol-bis(methylsulfonate) in 36.4 g of dimethylformamide is added dropwise over 45 minutes and the reaction mixture is stirred for 8 hours at 100° C. After this time the amine content is 0. The reaction solution is then evaporated to dryness, affording 57.5 g of the ammonium salt of formula

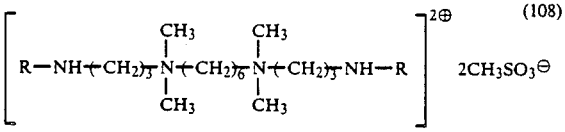

(108)

-continued

R = behenic acid radical

Example X 63.3 g of dimethylaminopropylbehenamide are fused at 80° C. Then 14.8 g of hydrochloric acid in 756.8 g of water are added dropwise to the melt while keeping the temperature at 60° C. Then 16.35 g of butanediol diglycidyl ether are added dropwise over 10 minutes and the reaction mass is stirred for 1 hour at 65°-70° C. After this time amine and epoxide numbers are 0.

850 g of a 10% solution of the diquaternary ammonium salt of of the following formula

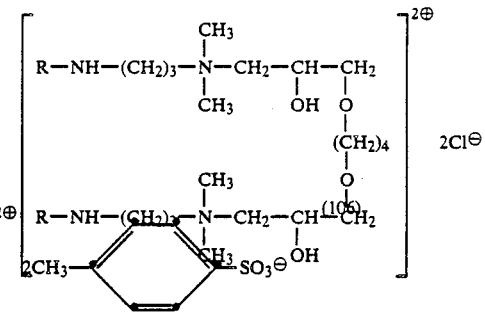

(109)

R = behenic acid radical are obtained.

Example XI 65.6 g of dimethylamino-n-propylbehenamide are fused at 80° C. and to this melt are added 5.1 g of sulfuric acid in 1083.6 g of water. To the reaction mixture are then added 16.35 g of 1,4-butanediol diglycidyl ether (epoxy number 4.6) at 60° C. over 10 minutes. The reaction mixture is heated to 70° C. and kept at this temperature for 10 hours. After this time the amine number is 28 and the epoxide number 0.

1170 g of a 7% solution of the diquaternary ammonium salt of formula

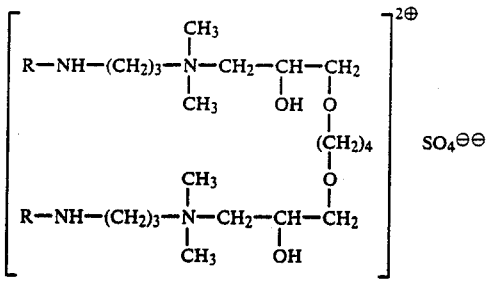

(110)

R = behenic acid radical are obtained.

Example XII 45.8 g of dimethylamino-neopentylbehenamide and 9.9 g of concentrated hydrochloric acid are heated in 500.4 g of water to 75° C. Then 10.9 g of 1,4-butanediol diglycidyl ether (epoxy number 4.6) are added over 15 minutes and the reaction mixture is stirred for 12 hours at 77°-78° C. After this time amine and epoxide numbers are 0.

567 g of a 10% solution of the diquaternary ammonium salt of formula

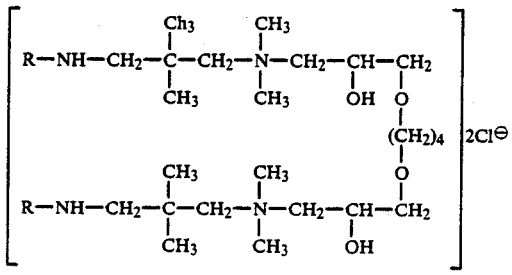

(111)

R = behenic acid radical are obtained.

Example XIII 42.3 g of diisopropylaminoethylbehenamide and 9.9 g of concentrated hydrochloric acid are heated in 479.8 g of water to 75° C. Then 10.9 g of 1,4-butanediol diglycidyl ether (epoxy number 4.6) are added over 15 minutes and the reaction mixture is stirred for 12 hours at 75° C. After this time amine and epoxide numbers are 0.

542 g of a 10% solution of the diquaternary ammonium salt of formula

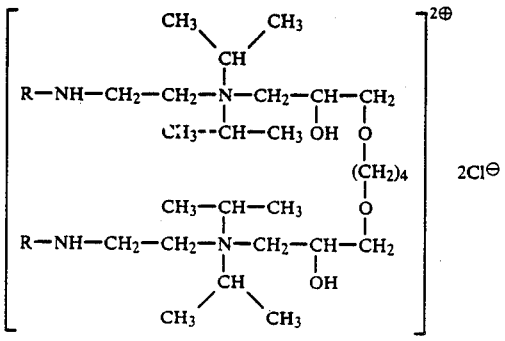

(112)

-continued

R = behenic acid radical are obtained.

Example A 134 g of N,N-dimethyl-N-hexadecylamine in 439.25 ml of water are charged to a reactor and heated to 70° C. with stirring. Then 46.25 g of epichlorohydrin are added dropwise and stirring is continued until no more free amine can be detected (after about 2 hours). The reaction mixture is cooled to room temperature, affording 620 g of a somewhat viscous solution containing 29% of the mixture of ammonium salts of formulae

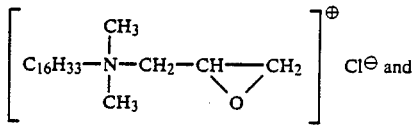

(120a)

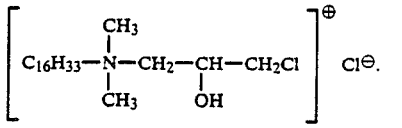

(120b)

Example B 134 g of N,N-dimethyl-N-hexadecylamine and 344.4 ml of water are charged to a reactor and heated to 70° C. Then 23.1 g of epichlorohydrin are added dropwise. After 1 hour a viscous solution forms, to which 27.2 g of 37% hydrochloric acid are added dropwise. After addition of half of the acid, the solution becomes gel-like and difficult to stir, whereupon 127.8 g of isopropanol are added. The resultant solution is clear and pale yellow. Yield: 657 g of a solution containing 24% of the reaction product of formula

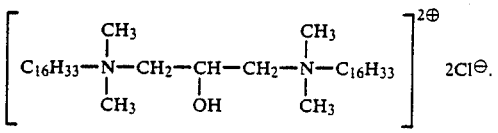

(121)

Example C 86.0 g of N,N'-tetramethylhexane-1,6-diamine are dissolved in 457 ml of water and to this solution are added 31.6 g of benzyl chloride. The resultant milky emulsion is heated, with stirring, to 50° C. until a clear solution is obtained. The solution is then heated to 70° C. and 23.4 g of epichlorohydrin are added. The solution so obtained is adjusted to pH 7-8 with hydrochloric acid and cooled to room temperature, affording 643 g of a solution which contains 22% of a mixture of the ammonium salts of formulae

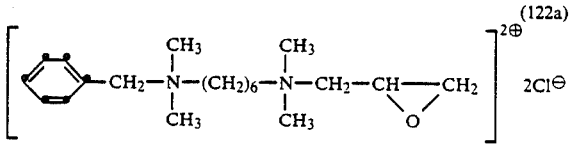

(122a)

and

-continued

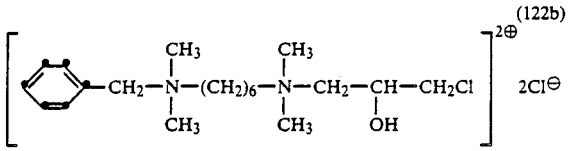

(122b)

Example D 106.5 g of N,N-dimethyl-N-laurylamine and 350 ml of water are charged to a reactor. With stirring, 46.25 g of epichlorohydrin are added at 20° C. and the mixture is warmed to 40° C., stirred for 2 hours at this temperature, and the pH is adjusted to 7.5–7.6 with 37% hydrochloric acid. Then 43.0 g of N,N'-tetramethylhexane-1,6-diamine are added at 20° C. and the mixture is heated to 70° C. The pH is adjusted to 7–8 with 37% hydrochloric acid and the reaction mixture is stirred for 6 hours, to give 600 g of a viscous solution containing 30% of the ammonium salt of formula

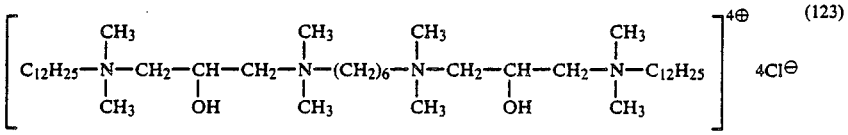

(123)

The same compound is also obtained by first reacting the N,N'-tetramethylhexane-1,6-diamine with epichlorohydrin and subsequently reacting the resultant product with N,N-dimethyl-N-laurylamine.

Example E 86.0 g of N,N'-tetramethylhexane-1,6-diamine are dissolved in 350 ml of water. With stirring and cooling, 46.8 g of epichlorohydrin are added dropwise at 20° C. and the mixture is subsequently stirred for 4 hours at 70° C. Towards the end of the reaction, the pH is adjusted to 7–8 with 49.3 g of 37% hydrochloric acid, to give 533 g of a solution containing 28% of a reaction product containing recurring units of the formula

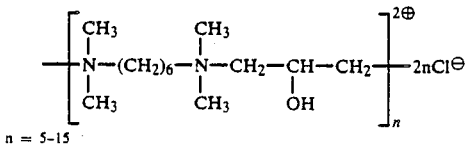

(124)

n = 5–15

Example F

With stirring, 118 g of 4,4'-bis(chloromethyl)biphenyl are suspended in 800 ml of water in a reactor and to this suspension are added 82 g of N,N'-tetramethylhexane-1,6-diamine. The mixture is heated to reflux and kept for 1 to 2 hours at 90°–100° C., whereupon a viscous solution with an initial pH of 11.7 forms. At the conclusion of the reaction, this solution is stabilised to a pH of 7–7.5.

1000 g of a solution containing 20% of a product containing recurring units of the formula

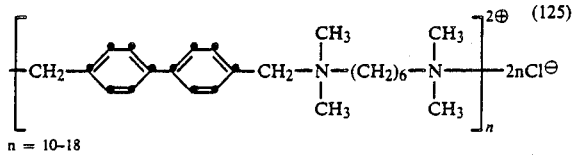

(125)

n = 10–18 are obtained. The product has a molecular weight of 4500–6300.

Example G

With stirring, 500 g of water and 168 g of ethylene glycol are heated to 90° C. Then a mixture of 470 g of pentamethyldiethylenetriamine and 579 g of dichloroethyl ether are added over 5 hours while keeping the temperature in the range from 90°–100° C. The reaction mixture is stirred for another 5 hours at 110° C. and excess diethyl ether is subsequently removed at 80° C. and $1.33 \cdot 10^4$ Pa. The product is adjusted to a content of 30% by addition of water, affording 2858 g of a solution of the quaternary polyadduct of formula

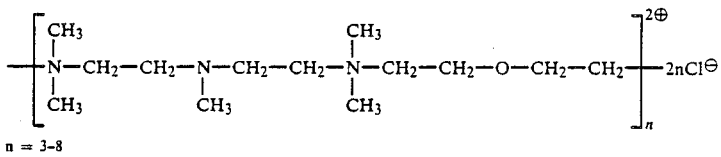

(126)

n = 3–8

The pH of a 5% aqueous solution is 4.0.

APPLICATION EXAMPLES

Example 1

In a dyeing apparatus, 10 g of chlorinated woollen fabric are dyed as follows:

Dyeing is commenced at 40° C. at a liquor to goods ratio of 1:30, with the goods being constantly agitated in the aqueous liquor. To this treatment bath are added, in succession, the following chemicals (the percentages are based on the weight of the fabric):

3% of crystalline sodium acetate,
3% of 80% acetic acid,
5% of sodium sulfate,
1% of a disulfonated tallow amine ethoxylate,
3% of a mixture of the dyes of formula (201)
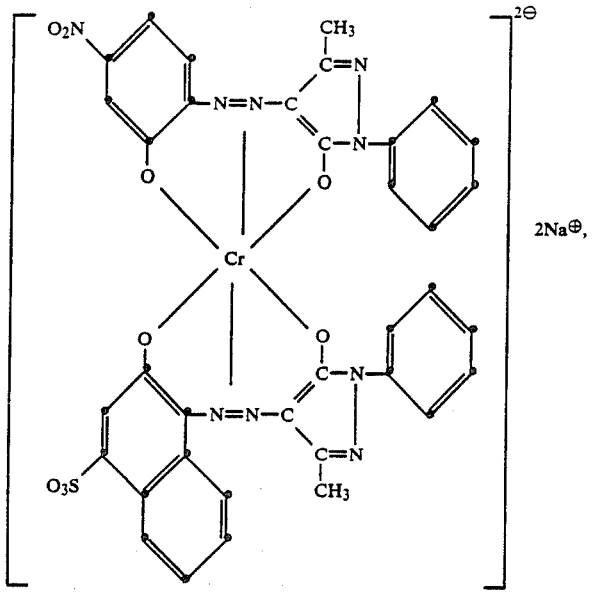
(202)
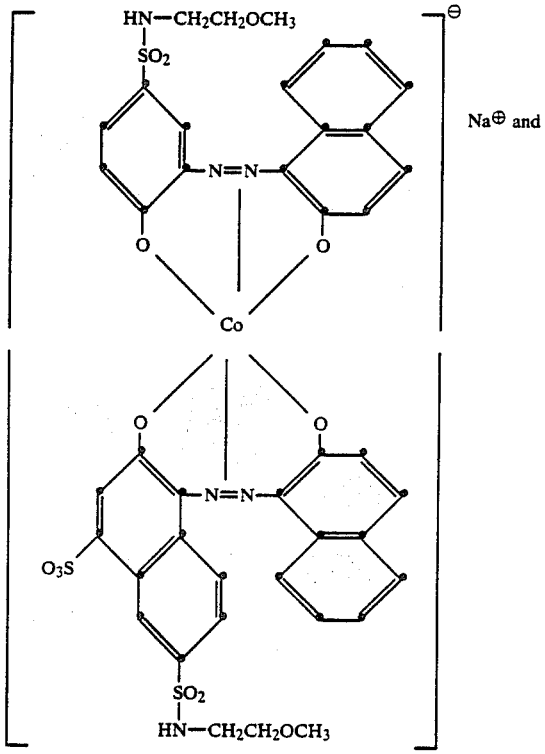
(203)
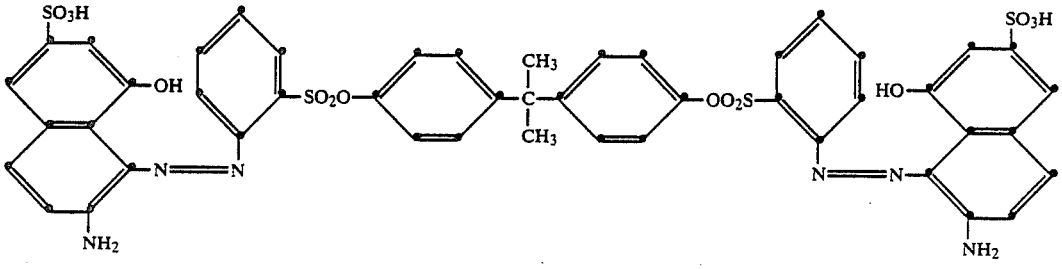
The goods are run for 10 minutes at 40° C. and then the bath is heated to 98° C. over 45 minutes and dyeing is carried out for 60 minutes at this temperature. The bath is cooled to 40° C. and the dyeing is rinsed until the rinsing liquor contains no more dye.

To a fresh bath of 40° C. (liquor ratio: 1:30) are added 0.6% of the ammonium salt of formula (101) and 0.6% of the polymeric ammonium salt of Preparatory Example F containing units of formula (125). After 10 minutes the pH is adjusted to 5 with acetic acid and treatment is continued for a further 15 minutes. The goods are then centrifuged and dried.

For comparison purposes, two further dyeings are prepared, one of which is aftertreated without the ammonium salt of formula (101) and the other without the compounds of formula (101) and Preparatory Example F. The three treated fabrics are then examined for soiling. The fastnesses of the dyeings are assessed for potting, wash 3 and xenon light.

The test for soiling is carried out as follows:

(A)

Dry soiling
- samples: woollen fabrics measuring 9×12 cm
- 15%, based on the weight of the wool, of sieved vacuum cleaner dirt
- apparatus: Turbulator (3 dimensional movement)
- treatment time: 30 minutes
- samples subsequently vacuum cleaned.

(B)

Wet soiling
- sample: 7.5 g of woollen fabric
- liquor to goods ratio: 1:50
- 5 g of filter dust (from the exhaust air plant of a building)
- 5 g of ECE test detergent 77 (ex Henkel)
- 0.1 g of lanolin ("dissolved" in hot water)
- treatment in a glass beaker in a heating medium temperature 60° C.
- treatment time: 20 minutes
- rinse cold, dry.

The results of the fastness and soiling tests are reported in Table 1.

TABLE 1

| Treatment | Potting | Wash 3 | Xenon light | Soiling dry | Soiling wet |
|---|---|---|---|---|---|
| according to Ex. 1 | 4 | 5 | 4–5 | none | none |
| as Example 1 but without compound (101) | 4 | 5 | 4–5 | severe | severe |
| as Example 1 but without compound (101) and (125) | 1 | 3–4 | 4–5 | none | none |

Comparably good results are obtained by replacing the polymeric ammonium salt containing units of formula (125) by the ammonium salts of formulae (120) to (123) or by the polymeric ammonium salts of Preparatory Examples E or G containing units of formula (124) or (126) respectively, and replacing the ammonium salt of formula (101) by the diquaternary ammonium salts of formulae (100) or (102) to (112).

Example 2

10 g pieces of chlorinated woollen fabric are wetted in an Ahiba dyeing apparatus at 40° C. with constant agitation. Then the following chemicals are added to the bath (percentages based on the weight of the goods):

- 4% of ammonium sulfate
- 3% of 80% acetic acid
- 2% of an amphoteric fatty amine polyglycol ether
- 3% of the dye of formula

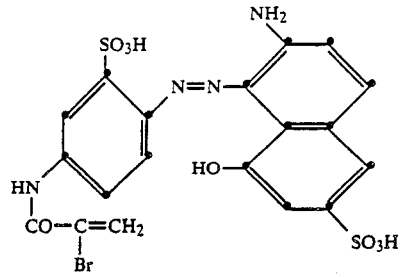

(204)

The dyebath is heated to the boil over 45 minutes and kept at the boil for 60 minutes. Then the bath is cooled and the goods are rinsed. The dyed goods are subjected to an aftertreatment in a fresh bath (liquor to goods ratio: 1:30) for 20 minutes at 40° C. with 1% of the reaction product of Preparatory Example G containing units of formula (126) and 0.6% of the ammonium salt of formula (101). The goods are then rinsed and dried.

Two parallel tests are carried out as described in Example 1. The fastness to perspiration, alkaline, the moist heat test and the fastness to xenon light are evaluated. The results are reported in Table 2.

TABLE 2

| Treatment | Perspiration alkaline | Moist heat 70° C. | Xenon light | Soiling dry | Soiling wet |
|---|---|---|---|---|---|
| according to Ex. 2 | 4 | 3–4 | 5 | none | none |
| as Example 2 without compound (101) | 4 | 3–4 | 5 | severe | severe |
| as Example 2 without compound (101) without compound (126) | 1–2 | 1–2 | 5 | none | none |

Comparably good results are obtained by replacing the ammonium salt of formula (101) by the diquaternary ammonium salts of formulae (100) or (102) to (112), and replacing the ammonium salt of formula (126) by the ammonium salts of formulae (120) to (123) or polymeric ammonium salts of Preparatory Examples E or F containing units of formulae (124) or (125) respectively.

Example 3

100 kg of woollen fabric are exhaust dyed on a winchbeck (liquor to goods ratio: 1:40) with 5% of a mixture consisting of the black dye, Acid Black 172 C.I. 15711, and the chromium mixed complex of the dyes of formulae

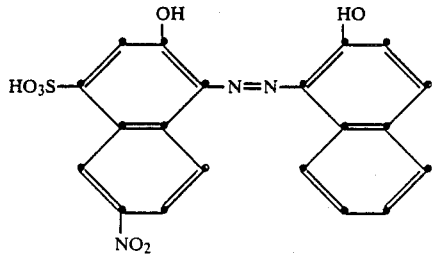

(205)

and

-continued

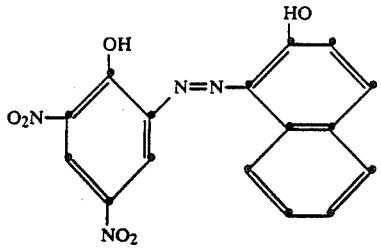

(206)

(ratio 1:1)

After cooling, rinsing and drying, the fabric is padded to a pick-up of 80% with an aqueous solution containing 15 g/l of the ammonium salt of formula (101)

15 g/l of the polyamidepolyamine (P) prepared in accordance with Example 1 of British patent specification No. 1 276 461, and 1 g/l of 80% acetic acid.

After it has been padded, the fabric is dried. An evaluation is then made of the potting fastness and soiling behaviour compared with the untreated dyeing and with a dyeing which has been aftertreated only with the polyaminepolyamide. The comparison tests are made as described in Example 1. The results are reported in Table 3.

TABLE 3

| Treatment | Potting | Soiling dry | Soiling wet |
|---|---|---|---|
| according to Ex. 3 | 4–5 | a trace | a trace |
| Example 3, but without compound (101) | 4–5 | severe | severe |
| Example 3, but without compound (101) and (P) | 1 | none | none |

Example 4

100 kg of woollen hand-knitting yarn are dyed at a liquor to goods ratio of 1:15 on a hank dyeing machine with 5% of a mixture of a 1:1 chrome complex dye of formula

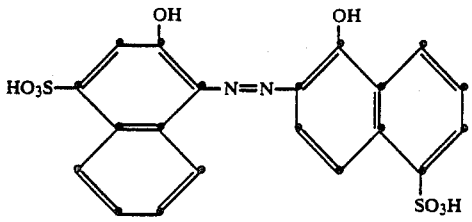

(207)

and a 1:1 chrome complex dye of formula

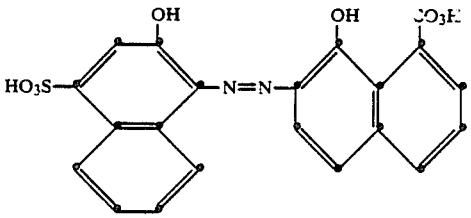

(208)

(ratio 3:2). The bath is subsequently cooled and the wool is rinsed.

The dyed wool is subjected as follows to an aftertreatment in the same apparatus, but in a fresh bath, at a liquor to goods ratio of 1:15.

To the treatment bath are added at 40° C.

1% of the reaction product of 1 mole of diethylenetriamine and 1 mole of dicyandiamide in accordance with Example 1 of German Auslegeschrift No. 1 595 390, and 1% of the ammonium salt of formula (101).

The wool dyeing is treated for 15 minutes at 40° C. The bath is then drawn off and the yarn is centrifuged and dried. The dyeing is assessed for fastness to perspiration, alkaline and acid, and for severe wet treatments and compared with the untreated dyeing. The results are reported in Table 4.

TABLE 4

| Treatment | Perspiration alkaline wool | Perspiration alkaline cotton | Perspiration acid wool | Perspiration acid cotton | Severe wet treatment wool | Severe wet treatment cotton |
|---|---|---|---|---|---|---|
| Example 4 | 5 | 4–5 | 5 | 4 | 5 | 4–5 |
| without after-treatment | 3–4 | 2–3 | 3–4 | 3–4 | 4 | 3–4 |

The soiling behaviour is also evaluated. The soiling tests are carried out as described in Example 1. The results are reported in Table 5.

TABLE 5

| Treatment | Soiling dry | Soiling wet |
|---|---|---|
| Example 4 | none | none |
| without compound (101) | severe | severe |
| without after-treatment | none | none |

Example 5

In a dyeing apparatus, 5 kg of chlorinated wool top are put into 50 liters of water at 60° C. with the addition of 0.5% of an adduct of 1 mole of $C_9$ alkanol and 4 moles of ethylene oxide and 8 moles of propylene oxide. Then 3% of 80% acetic acid 5% of calcined sodium sulfate, and 0.5% of an amphoteric fatty amine polyglycol ether are added. The goods are circulated for 10 minutes at 60° C. until the chemicals are homogenised and then 5% of the dye, Acid Black 172 C.I. 15711, are added.

The bath is heated to 85° C. over 25 minutes and dyeing is carried out for 60 minutes at this temperature. To the completely exhausted dyebath are then added 3% of the diquaternary diammonium salt of formula (109) and 3% of the polyammonium salt of Preparatory Example G containing units of formula (126).

The goods are treated in the cooling bath, preferably at 40°–50° C., for 15 minutes, then rinsed and dried.

The resultant strong, level, black dyeing has a potting fastness rating of 4–5. The top has a very soft handle, which has a positive influence on the further processing.

A strong, level wool dyeing of good potting fastness and with a soft handle is also obtained by replacing the polyammonium salt of Preparatory Example G by the same amount of one of the ammonium salts of Preparatory Examples A to F.

Example 6

100 kg of untreated loose wool is wetted at 60° C. in a circulation dyeing machine in 2000 liters of water containing the following additives:

2% of 80% acetic acid
5% of calcined sodium sulfate
1% of a disulfonated tallow fatty amine ethoxylate, and
0.5% of an amphoteric fatty amine polyglycol ether.

After 10 minutes, 3% of a mixture of the 1:2 mixed chromium complex of the dyes of formulae (205) and

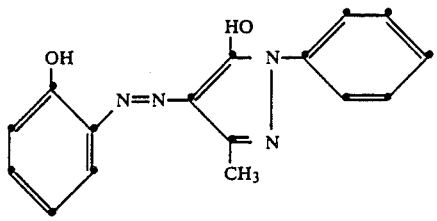

(209)

and the 1:1 mixed chromium comlex of the dyes of formulae

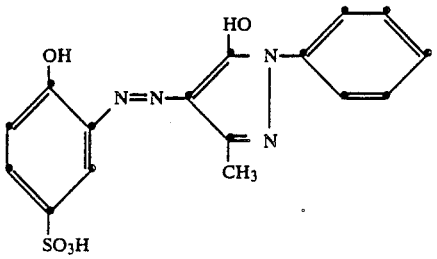

(210)

and

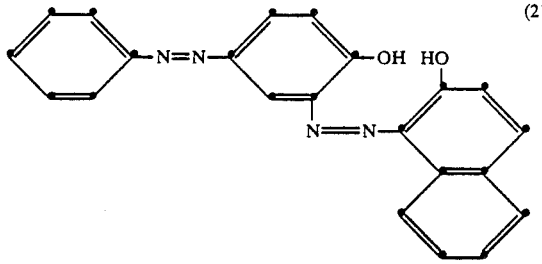

(211)

is added.

The dyebath is heated to the boil over 20 minutes and kept at the boil for 1 hour. Half of the dyebath is then drawn off and the bath is replenished with fresh cold water. The following ingredients are then added at 50° C.:

2% of the diquaternary diammonium salt of formula (109) of Preparatory Example X,
1% of the polyammonium salt of Preparatory Example E, and
1% of the polyammonium salt of Preparatory Example G.

The wool is treated for 15 minutes at 50° C., then rinsed and dried. The wool has a full, level, brown shade and a potting fastness rating of 4. The wool has a pleasing soft handle.

Example 7

In a dyeing apparatus, a 1 kg cheese of pure untreated wool is wetted at 60° C. in 5 liters of water with the addition of 1% of an adduct of 1 mole of $C_9$ alkanol and 4 moles of ethylene oxide and 8 moles of propylene oxide. The following ingredients are then added:

3% of 80% acetic acid
5% of calcined sodium sulfate
0.5% of an amphoteric fatty amine polyglycol ether,
5% of the dye, Acid Black 172, C.I. 15711.

The goods are circulated for 10 minutes at 60° C. and the bath is then heated for 25 minutes to boiling temperature and dyeing is carried out for 20 minutes at this temperature. To the completely exhausted bath are then added 4% of the diquaternary diammonium salt of formula (110),
2% of the polyammonium salt of Preparatory Example G,
3% of sodium m-nitrobenzenesulfonate.

The wool is treated in the cooling bath, preferably at 40°–50° C., for 15 minutes, after which it is rinsed and dried. The wool is dyed in a level black shade with a potting fastness rating of 4–5. The wool has a soft handle.

A level, strong wool dyeing of good potting fastness and with a soft handle is also obtained by replacing the polyammonium salt of Preparatory Example G with the same amount of an ammonium salt of Preparatory Examples A to F.

What is claimed is:

1. An assistant combination for use as textile finishing agent, which comprises (1) a diquaternary ammonium salt of formula

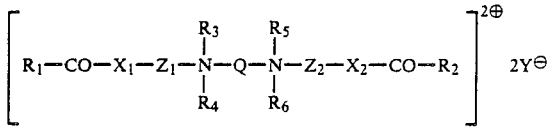

(1)

wherein

Q is a divalent aliphatic hydrocarbon radical of 2 to 12 carbon atoms which may be interrupted in the chain by oxygen atoms and is unsubstituted or substituted by hydroxy, $R_1$ and $R_2$ are each independently of the other an aliphatic radical of 6 to 24 carbon atoms, $R_3$ to $R_6$ are each independently of the other lower alkyl, hydroxy-lower alkyl or lower alkoxy-lower alkyl, $X_1$ and $X_2$ are each oxygen or —NH—, $Z_1$ and $Z_2$ are each independently of the other $C_2$–$C_6$ alkylene, and $Y^{\ominus}$ is an anion of a strong inorganic or organic acid, and (2) (A) a mono- or polyquaternary ammonium salt which carries at least one hydrocarbon radical of not less than 7 carbon atoms attached to the nitrogen atom, or (B) a polymeric ammonium salt, or (C) a basic non-quaternised nitrogen-containing polycondensate.

2. An assistant combination according to claim 1, wherein $R_1$ and $R_2$ are each independently of the other a $C_{19}$–$C_{21}$ alkyl radical.

3. An assistant combination according to claim 2, wherein $X_1$ and $X_2$ are each independently of the other —NH—.

4. An assistant combination according to claim 3, wherein $Z_1$ and $Z_2$ are each ethylene or propylene.

5. An assistant combination according to claim 4, wherein Q is a $C_3$–$C_{10}$ alkylene radical which may be interrupted in the chain by oxygen and is unsubstituted or substituted by hydroxy.

6. An assistant combination according to claim 5, wherein component (2) is a mono- or diquaternary ammonium salt of formula

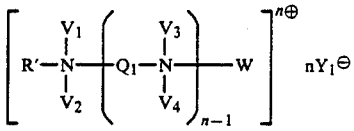

(3)

wherein $Q_1$ is a $C_2$–$C_{12}$ alkylene radical which may be interrupted by oxygen or —NV and is unsubstituted or substituted by hydroxy, R′ is an aliphatic radical of 6 to 24 carbon atoms or an araliphatic radical, $V_1$ to $V_4$ are each independently lower alkyl or hydroxy-lower alkyl, W is

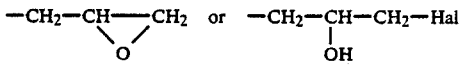

Hal is a halogen atom, n is 1 or 2, and $Y_1^{\ominus}$ is an anion of a strong inorganic or organic acid.

7. An assistant combination according to claim 5, wherein component (2) is a diquaternary or tetraquaternary ammonium salt of formula

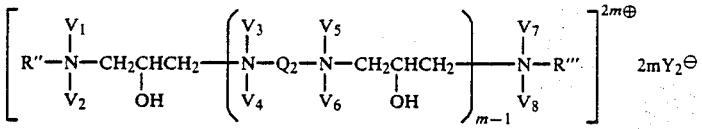

wherein $Q_2$ is a $C_2$–$C_{12}$ alkylene radical which may be interrupted by oxygen or —$NV_9$ and is unsubstituted or substituted by hydroxyl, R″ and R‴ are each independently of the other an aliphatic radical of 6 to 24 carbon atoms or an araliphatic radical, $V_1$ to $V_9$ are each independently lower alkyl or hydroxy-lower alkyl, m is 1 or 2, and $Y_2^{\ominus}$ is an anion of a strong inorganic or organic acid.

8. An assistant combination according to claim 5, wherein component (2) is a polymeric ammonium salt which contains the recurring unit of formula

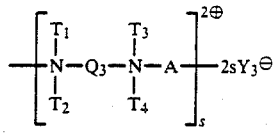

(5)

wherein $Q_3$ is a $C_2$–$C_6$ alkylene radical which may be interrupted by —$NT_5$—, $T_1$ to $T_5$ are each independently lower alkyl or hydroxy-lower alkyl, A is a group selected from

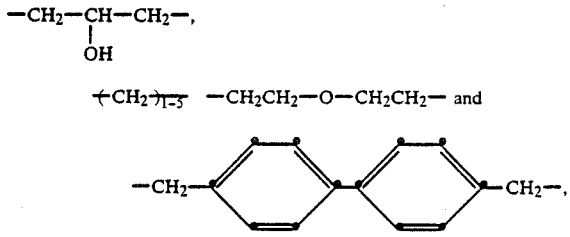

s is 3 to 100, and $Y_3^{\ominus}$ is the anion of a strong inorganic or organic acid.

9. An assistant combination according to claim 5, wherein component (2) is a polymeric ammonium salt which contains the recurring unit of formula

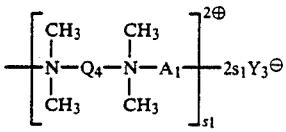

(6)

wherein $Q_4$ is —$(CH_2)_6$— or

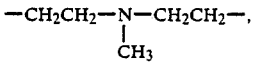

$A_1$ is a group selected from

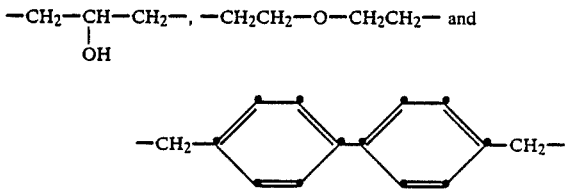

$s_1$ is 3 to 30, and $Y_3^{\ominus}$ is an anion of a strong inorganic or organic acid.

10. An assistant combination according to claim 5, wherein component (2) is an amino group containing condensate which is obtained by reacting dicyandiamide, cyanamide, guanidine or bisguanidine and a polyalkylamine containing not less than three amino groups.

11. An assistant combination according to claim 5, wherein component (2) is a basic polyamide which is obtained by condensation of a polymeric fatty acid and a polyalkylenepolyamine containing not less than 4 to 12 carbon atoms.

12. An assistant combination according to claim 1, which contains components (1) and (2) in a weight ratio of 3:1 to 1:5.

13. A process for aftertreating wool-containing fibre material dyed with anionic dyes, which comprises treating said material with an aqueous liquor that contains an assistant combination comprising (1) a diquaternary ammonium salt of formula (1)

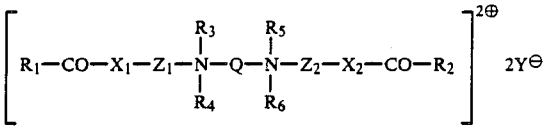

wherein

Q is a divalent aliphatic hydrocarbon radical of 2 to 12 carbon atoms which may be interrupted in the chain by oxygen atoms and is unsubstituted or substituted by hydroxy, $R_1$ and $R_2$ are each independently of the other an aliphatic radical of 6 to 24 carbon atoms, $R_3$ to $R_6$ are each independently of the other lower alkyl, hydroxy-lower alkyl or lower alkoxy-lower alkyl, $X_1$ and $X_2$ are each oxyen or —NH—, $Z_1$ and $Z_2$ are each independently of the other $C_2$–$C_6$ alkylene, and $Y^{\ominus}$ is an anion of a strong inorganic or organic acid, and (2) (A) a mono- or polyquaternary ammonium salt which carries at least one hydrocarbon radical of not less than 7 carbon atoms attached to the nitrogen atom, or (B) a polymeric ammonium salt, or (C) a basic non-quaternised nitrogen-containing polycondensate.

14. A process according to claim 13, wherein the aftertreatment is carried out by an exhaust process.

15. A process according to claim 14, wherein the aftertreatment is carried out in a temperature range from 20° to 80° C.

* * * * *